US006522061B1

(12) United States Patent
Lockwood

(10) Patent No.: US 6,522,061 B1
(45) Date of Patent: Feb. 18, 2003

(54) FIELD EMISSION DEVICE WITH MICROCHANNEL GAIN ELEMENT

(76) Inventor: Harry F. Lockwood, 21 White Oak Rd., Waban, MA (US) 02168

( * ) Notice: Subject to any disclaimer, the term of this patent is extended or adjusted under 35 U.S.C. 154(b) by 0 days.

(21) Appl. No.: 09/622,701

(22) PCT Filed: Mar. 16, 1998

(86) PCT No.: PCT/US98/05127

§ 371 (c)(1),
(2), (4) Date: Aug. 21, 2000

(87) PCT Pub. No.: WO99/48121

PCT Pub. Date: Sep. 23, 1999

Related U.S. Application Data

(63) Continuation-in-part of application No. 08/416,078, filed on Apr. 4, 1995, now Pat. No. 5,849,333.

(51) Int. Cl.[7] ..... H01J 1/02; H01J 19/10; H01J 43/00

(52) U.S. Cl. ..... 313/495; 313/103 CM; 313/105 CM; 313/306; 313/308; 313/309; 313/311; 313/336; 313/351; 313/497

(58) Field of Search ..... 313/495, 103 CM, 313/306, 101 CM, 308, 309, 336, 351, 497

(56) References Cited

U.S. PATENT DOCUMENTS

| | | | | |
|---|---|---|---|---|
| 3,387,137 | A | 6/1968 | Adams | 313/528 |
| 3,424,909 | A | 1/1969 | Rougeot | 313/528 |
| 3,772,551 | A | 11/1973 | Grant | 313/534 |
| 3,868,536 | A | 2/1975 | Enck, Jr. | 315/12.1 |
| 3,902,240 | A | 9/1975 | Chang, et al. | 313/534 |
| 3,904,923 | A | 9/1975 | Schwartz | 345/74 |
| 4,001,619 | A | 1/1977 | Endriz, et al. | 345/74 |
| 4,001,620 | A | 1/1977 | Endriz | 345/74 |
| 4,030,090 | A | 6/1977 | Endriz | 345/74 |
| 4,051,468 | A | 9/1977 | Rajchman | 345/74 |
| 4,077,054 | A | 2/1978 | Endriz | 345/74 |
| 4,137,551 | A | 1/1979 | Rajchman | 345/74 |
| 4,577,133 | A | 3/1986 | Wilson | 313/103 |
| 4,978,885 | A | 12/1990 | White et al. | 313/103 CM |
| 5,086,248 | A | 2/1992 | Horton et al. | 313/103 CM |
| 5,378,960 | A | 1/1995 | Tasker et al. | 313/534 |
| 5,378,963 | A | 1/1995 | Ikeda | 313/103 |

*Primary Examiner*—Ashok Patel

(57) ABSTRACT

A field emission device with a micro-channel gain element included a plurality of field emission or "cold" cathodes (102) formed into an array. The cold cathodes are typically modulated by a grid (108) having a driving voltage. A microchannel gain element (114) is secondary electron emissive material within each of the channels. The channels correspond number and location to the cathode and enable multiplication of electron emitted by the cathodes. Multiplication of the electrons enables the cathodes to be driven at a lower current of emitted electrons than normally applied, absent the microchannel, to obtain the same resulting beam. The beam existing each of the micro-channels is directed to an anode (130), which can include a phosphor (128) for use in a flat panel display. Alternatively, anode can include a semiconductor substrate having a reactive resist, and an electrostatic lens structure can be employed to focus the beams to produce a mask pattern on the substrate according to a predetermined mask pattern.

26 Claims, 9 Drawing Sheets

FIELD EMISSION DEVICE WITH MICROCHANNEL GAIN ELEMENT

RELATED APPLICATION

This is a U.S. national application of PCT/US98/05127, filed Mar. 16, 1998, which is a continuation-in-part of copending U.S. patent application Ser. No. 08/416,078, filed Apr. 4, 1995, now U.S. Pat. No. 5,849,333, which issued Dec. 15, 1998.

FIELD OF THE INVENTION

This invention relates to field emission devices and more particularly a field emission device utilizing a microchannel gain element to multiply electron emission.

BACKGROUND OF THE INVENTION

It has become increasing common in the construction of image-generating devices to utilize a field emission device or "cold" cathode as a source of electrons for exciting a surface that generates a visible light. The cathode is placed in a vacuum enclosure and electrons are emitted from the cathode by action of a strong electric field adjacent the cathode. The electric field results from the cathode's geometry and from the use of a collector or anode adjacent the cathode. The anode is biased with a strong positive electric potential relative to the cathode. The emitted electrons generate a beam that passes between the cathode and anode. This beam can be modified by a third electrode known as a gate or grid. Further electrodes can also be added within the vacuum space between the cathode and the gate to further modify the electron beam. The resulting assembly can be termed a triode, tetrode, pentode, or the like, depending upon the number of electrodes present, in addition to the anode and cathode.

A generalized field emission device according to the prior art is detailed schematically in FIG. 1. The cathode 20 includes an emitter section 22 having a sharp emitter point 23. The emitter 22 is located behind a gate 24 having an opening 26 through which electrons pass to strike an anode 28. The cathode 20, gate 24 and anode 28 are separated from each other spatially and are enclosed in an evacuated envelope 30. Field emission or "cold" cathodes such as cathode 20 are known generally to those who are skilled in the art. Current methods of fabricating and characterizing these devices is described in a special issue of the Journal of Vacuum Science and Technology B. Microelectronics and Nanometer Structures, Second Series, vol. 12, no. 2. March/April 1994and is hereby expressly incorporated herein by reference.

When the anode 28 of FIG. 1 is employed as a display device (such as in a flat panel display) a phosphor is provided integrally to the anode. The phosphor is sensitive to electron excitation and emits visible light. Likewise, the cathodes 20 are organized in arrays that are addressable to generate an image. Where the structure of FIG. 1 is to be employed in electron microscope, the object to be analyzed is part of the anode 28.

In a display device, the brightness of light emitted by the phosphor screen depends upon the density of electrons that strike a given area of the screen and the energy derived from the voltage difference between the anode and the cathode. The brightness also depends upon the efficiency of the phosphor in converting the energy of electrons to photons of visible light. Typically, to achieve a high current density, and therefore a high-brightness in a display device the electric field that extracts electrons at the emitter 22 must be in the range of $10^7$ Volts/centimeter. This high field strength invariably leads to cathode tip damage by erosion. Such erosion makes the emitted beam unstable in the short term and impairs long-term reliability. Thus, erosion makes construction of flat panel displays using the structure FIG. 1 limited in brightness. Cathode damage and beam instability are also encountered in developing electron sources for integrated circuit lithography and electron microscopy.

IBM Research Report RC19596 (86076), Jun. 3, 1994, entitled "Emission Characteristics Of Ultra-Sharp Cold Field Emitters" (now published in the Journal of Vacuum Science & Technology. B12(6), p.3431. Nov./Dec. 1994) by Ming L. Yu, et al describes cathode deterioration at high current densities due to ohmic power dissipation, electron static stress and ion etching from residual gases in the evacuated space. The report also relates to long term and short term current instabilities during electron emission at high current densities.

It is desirable that electrons emitted by each cathode be as concentrated as possible when used in a display device. Transverse spreading of electrons generates larger pixels and, thus, lowers the density of pixels on the screen. Spreading of the electron beam also results in noise and reduced contrast, since electrons strike the phosphor in an area other than the intended pixel. To combat spreading, displays according to the prior art have located the anode/phosphor screen as close to the cathode array as necessary to attain desired resolution, contrast and signal-to-noise ratio. However, the placement of the anode and cathode in close proximity makes construction difficult and imposes design constraints that increase construction cost and/or degrade performance.

While the cathode structure FIG. 1 can also be utilized in a color display device, by providing phosphors of three different colors (red, green and blue, for example) in a cluster with three independent emitters, the above-described problems remain. Additionally, accurate control of color generated by the three, clustered, subpixels must also be maintained. Electron beam spread and instability complicate the maintenance of good color fidelity.

In order to overcome the problems inherent in a field emission cathode operating at high current, it is contemplated that the cathode can be operated at a substantially lower current. However, a lower current, while reducing erosion and increasing electron beam stability, does not generate a beam of sufficient density. The resulting weak beam is typically insufficient to cause currently available phosphors to emit a bright visible light. The emitted electron beam is also insufficient to perform detailed electron microscopy or electron beam lithography with improved performance and results.

In the field of lithography for producing integrated circuits, in particular, the goal is to create complex, microscopic circuit patterns on a semiconductor wafer substrate composed, for example, of silicon or gallium arsenide. To accomplish the patterning process, the wafer is first covered with a protective layer of polymeric, light-sensitive material, known as a photoresist. The photoresist is dried by a baking or "curing" process, and then is exposed selectively to light in a pattern defined by a "mask" having transparent and opaque areas analogous to the desired circuit pattern. Where the mask is transparent, light passes through, onto the substrate, exposing each portion of the circuit pattern. The exposed circuit pattern on the substrate undergoes a chemical change in response to the light, while the remaining unexposed photoresist is unchanged chemically. When the photoresist is "developed," in a manner similar to photographic film, a defined circuit pattern on the substrate at a microscopic level results. The developed photoresist enables selective processing of the semiconductor wafer to produce a layered structure with a variety of conducting, semiconducting and insulating media that define the finished circuit.

A mask can be placed directly on the surface of the substrate to produce a 1:1 scale image on the substrate. This is termed "contact lithograplhy." since the mask essentially contacts the substrate. Alignment of the mask is important in a contact arrangement, and a special contact aligner is used for this purpose, since the mask must maintain alignment with the substrate within a close tolerance range as the substrate undergoes several different layers of lithography.

Other techniques for producing circuit patterns on a substrate entail the use of "proximity alignment," "projection alignment," or "step-and-repeat alignment." The most widely employed in the semiconductor industry is currently the step-and-repeat technique. A "stepper" mechanism transfers the image from a relatively larger 5× or 10× scale (for example) mask to the substrate using, a reduction process that employs a sophisticated optical system. The substrate is moved in increments, or "stepped," under the optical system as the process proceeds incrementally to expose the entire wafer. Typically, lithography is one of the slowest steps in the fabrication of wafers. The wafer throughput of a current stepper is on the order of one hundred wafers per hour.

In each of the above-described photoresist exposure techniques, visible or ultraviolet light is generally used to as the exposure agent. The wavelength of light poses a general limit on the width of circuit lines on an exposed substrate. In general, line width of no less than 180 nm can be produced using light in the ultraviolet region of the spectrum. Conversely, electron beams can be focused to a much-finer extent. Using an electron beam, lines having a width of 20 nm or less can be achieved, essentially an order of magnitude finer than that possible with photolitlhographic processes. This enables much denser packing of transistors onto a given area enabling higher performance in a smaller package.

Conventional electron beam lithography techniques are limited in that they require the substrate to be exposed by the beam in a serial fashion by scanning the beam over the substrate, typically in a line-by-line (raster-style) manner. The scanning time involved is significantly longer than the step-and-repeat (stepper) method using visible or ultraviolet light.

In order to improve the throughput of electron beam lithography, research has been conducted by several investigators using arrays of parallel electron beams. The source of the electrons is typically an array of electron emitters. Such emitters have generally comprised "cold" cathodes, since hot cathodes (heated wires) or "warm" cathodes (Schottky emitters) generate excess heat when closely packed together. With a sufficiently large array of emitters and a corresponding array of electron beam lenses to focus the output of the emitters it has been possible to increase the throughput of patterned semiconductor wafers substantially.

In operation, the array of emitters is matrix-addressable. That is, a given field emission device in the array can be individually addressed via row and column drivers. A typical field emitter consists of a cathode tip(s) and a gate or "grid." When a particular row and column in the array are energized by the application of a suitable voltage, the emitter at the intersection of the row and column addresses is activated, and emits electrons. The electron beam lens corresponding, to the location of the emitter focuses the emitted electrons onto an anode, typically with an energy of 1,000 to 100,000 electron Volts. In this example, the anode is a wafer substrate coated with a resist that is sensitive to the impacting electron beam. Thus, a focused spot pattern is formed on the wafer. If the wafer is moved relative to the incident electron beam, then a focused line is patterned on the resist of the wafer. Likewise, each emitter can independently pattern a line in the substrate. It follows that, if two adjacent emitters in a row are activated simultaneously, then the motion over the spacing between the emitters produces a line twice as long as that produced by a single emitter. Likewise, if all the emitters in a row are activated simultaneously a line is patterned in the substrate that corresponds to the full length of the row of emitters even though the total motion to produce the line is limited only to the distance between emitters. In this parallel method of patterning the wafer it is hence, possible to improve the wafer throughput substantially beyond what is possible in the serial method described above.

However, in order to achieve sufficient electron beam current to expose the pattern in the resist-coated wafer, the field emission cathodes of the prior art are operated at current levels that cause short-term instability and poor long-term reliability. Thus, while the parallel method of electron beam lithography is attractive for its potentially high throughput, and for obtaining linewidths not possible with photolithography it is limited in application by significant reliability consideration—considerations that clearly do not lend the technique to mass-production semiconductor fabrication processes.

Accordingly, it is an object of this invention to provide a field emission device structure that enables operation of a field emission cathode at a lower current without the corresponding loss in electron beam strength. The structure should be capable of tightly focusing the generated beam even when the anode is located at an increased distance from the cathode. In a display, the cathode should generate a beam that triggers sufficient visible light emission in conventional phosphors. The generated beam should be stable and the cathode should have increased reliability due to reduced erosion. In electron beam lithography, the generated beam or beams should enable rapid and finely focused exposure of a circuit pattern on a semiconductor substrate generally coated with a resist that is reactive to the impacting electrons.

SUMMARY OF INVENTION

A field emission device, with a microchannel gain element according to this invention, provides an array of field emission or "cold" cathodes located on a substrate. The cathodes can be addressed individually or in groupings that correspond, in an image display device, to pixels. A gate or grid system is typically located in conjunction with the cathode array and is driven at a constant voltage with a superimposed modulating voltage to control emission of the cathodes. The cathodes are located in an evacuated space so that, upon application of a predetermined voltage, an electric field enables emission of electrons from individually addressed cathode emitters. The emitted electrons pass through the gate or grid and, according to this embodiment, enter a microchannel gain element. The microchannel gain element includes a pair of opposing anode sides that are driven at a voltage difference. The microchannel gain element also includes a plurality of microchannels that correspond to each of the cathodes. The microchannels include a secondary-electron-emissive layer therein. When electrons from each of the cathodes strike the emissive layer, the emissive layer generates additional electrons. A cascade effect ensues as electrons pass down each of the microchannels, and the resulting electron beam that exits each of the channels typically has a gain in a range of 100–200 (or more) relative to the entering electron stream. The use of a gain element enables the current generated by each of the cathodes to be substantially lower for a given anode current. This lower current adds to electron beam stability and reduces erosion of cathode emitters. A substantially conventional anode is located adjacent the exit of the microchannel structure.

The anode, in an image device, can comprise a glass, or other transparent material, plate having a phosphor and a thin metallic film thereon. Alternatively, in an electron microscope, the anode can include the object being viewed. In a lithographic process, the anode can include a semiconductor wafer coated with a sensitive resist. In particular, the anode can comprise a semiconductor substrate having a reactive resist, and an electrostatic lens structure can be employed to focus the beams to produce a pattern on the substrate according to a predetermined geometric design. The pattern is provided to an address controller that selectively activates the emitters and gating structure, or "grid," to reproduce the mask pattern in a single pass, or a sequence of passes. The lens structure can comprise a plurality of plates driven by predetermined voltages and stacked with apertures aligned with the emitters and outlets of the microchannel plate. A plurality of stacked microchannel plates can be provided with channels aligned to further increase the gain of the beam entering the lens structure.

In all of the above-described embodiments, the use of a microchannel gain element enables generation of more-stable electron beams and increases cathode reliability and life. The microchannel plate according to this invention can be formed in a variety of ways from a variety of materials. The construction lends itself to improved electron beam lithographic processes and enables the formation of high resolution pixels and/or circuit pathways.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
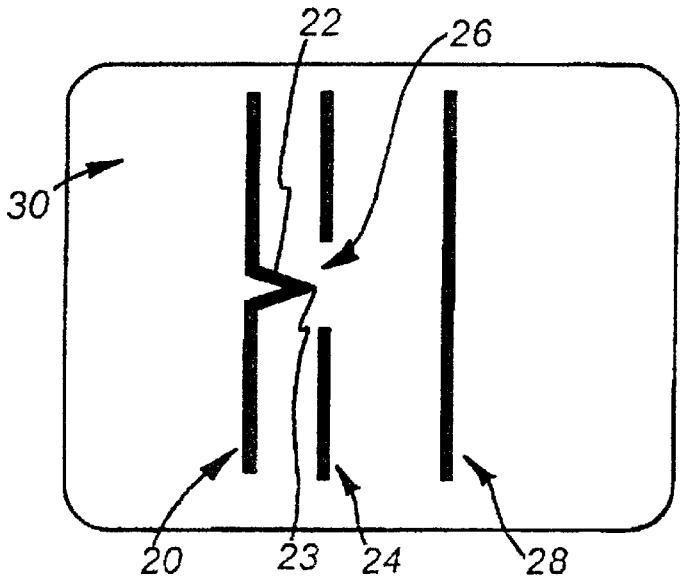
Fig. 1 (PRIOR ART)
FIG. 1 is a schematic cross-section of a field emission device according to the prior art.
Figure 2:
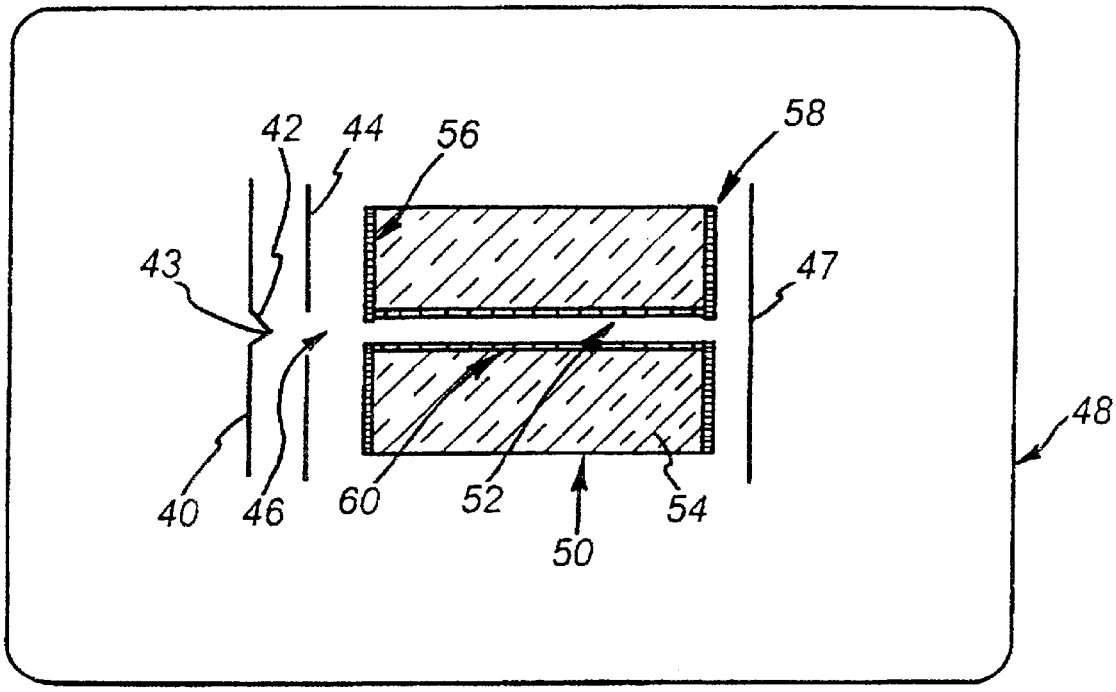
FIG. 2 is a schematic side view of a field emission device including a microchannel (lain element according to this invention.

FIG. 2 illustrates a basic embodiment of a field emission device with microchannel gain element according to this invention. The cathode 40 includes an emitter structure 42 formed conventionally according to this invention. A conventional gate structure 44 having an opening 46 is provided in conduction with and adjacent the cathode 40. Some examples of field emission device cathodes, typically containing sharply tipped points, are structures formed from metal such as molybdenum, nickel or tungsten deposited on, for example, glass or silicon. Diamond can possibly be employed, and materials such as gallium nitride and metal carbides have been investigated as possible cathode structures.

The cathode includes an emitter tip 43 that is pointed to generate a very high local electric field. Shaping of the tip 43 is accomplished by etching and/or depositing a tip of material or forming a thin ridge with a sharp edge on the active region. Cathodes will emit electrons in a vacuum when excited with grid voltages ranging from less than 10 Volts (the Matsushita Tower Cathode, for example) to approximately 150 Volts.

The emission voltage depends largely upon materials and geometry. The electric field requisite for emission is approximately $10^7$ Volts/cm. An anode 47 is provided remote from the cathode 40. In a display device, the anode is typically a thin conducting film such as vapor-deposited aluminum. As noted above, the anode can include a phosphor for emitting visible light in a display device embodiment. Alternatively, the anode 47 can comprise an object being viewed through an electron microscope or a lithographic target. By "anode" it is meant a display screen, a lithographic target including a semiconductor wafer substrate, a microscopic object or any other structure intended to selectively receive beams of electrons. It can be assumed that a plurality of cathodes 40 and emitters 42 are provided in, for example, a panel display. Tile entire structure is surrounded by a vacuum envelope 48 that can comprise glass or a similar sealed structure. Between the grid 44 and the anode 47 is located a microchannel structure 50. It is the microchannel that enables multiplication of electrons emitted by the cathode emitter 42 according to this invention.

The microchannel 50 includes a series of through passages such as channel 52. Each channel is located adjacent an emitter 42 so that emitted electrons arc aligned with the channel 52. The channel according to this invention is typically in the range of 0.1 to 1 millimeter in length and approximately 2 to 30 microns in diameter. The channel can be constructed with a body or substrate 54 of silicon, glass, metal (such as aluminum) or another suitable base material. Note that, if the body is conductive, it should be suitably electrically isolated as shown generally in FIG. 4. The front and rear surfaces of the channel, adjacent the grid 44 and the anode 47 are coated with conductive electrodes 56 and 58, respectively. The coating typically consists of a conductivity modifier, dopant or vapor-deposited material applied to the body material 54. The construction of a microchannel display according to this invention is described further below.

Within the surface of the microchannel 52 is disposed a secondary electron emissive layer 60 according to this invention. The electrodes 56 and 58 are driven at a constant voltage potential (between each other) ranging from approximately 600 to 1000 Volts according to this embodiment. The driving of the microchannel 50 at this voltage will generate a gain in the range of approximately 100 to 200 times.

Figure 3:
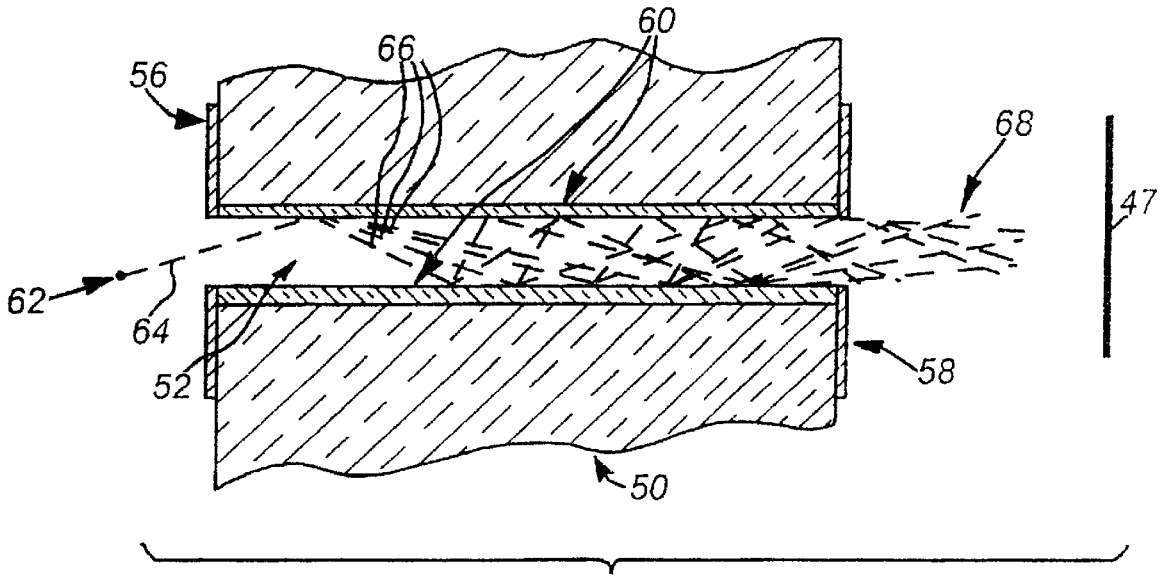
FIG. 3 is a schematic cross-section of the microchannel gain element of FIG. 2.

Operation of the microchannel 50 is detailed more particularly in FIG. 3 An electron 62 enters the channel 52 along a path 64 shown as a dotted line. When the electron 62 comes into contact with the secondary electron emissive layer 60 (sometimes referred to as a dynode due to the analogous dynode structure in a photomultiplier tube), the electron causes the emission of a plurality of electrons that, typically, project along a series of paths 66 to each strike tile emissive layer 60, yet again. Each emitted electron that strikes the emissive layer 66 again generates a further multiplicity of emitted electrons forming a continuously cascading group of electrons that finally exits the channel 52 as a multiplied electron beam 68. As noted, this multiplication can be substantially more than 100 to 200 times. The resulting beam 68 is formed of a large number of energized electrons that according to this embodiment, are sufficient to cause a phosphor to glow brightly as the beam's electrons are collected at the anode 47.

A practical application of a microchannel 50 according to this embodiment entails the use of an array of such microchannels, known as microchannel plates. Microchannel plates were originally developed for image intensifier tubes in night vision application. Because of the (rain generated by the microchannel plate, the anode current can be may orders of magnitude greater than the current emitted by the cathode. The gain can be as much as $10^8$. Hence, low-light images focused on a photocathode are transferred to an anode/screen with a much higher intensity. In a night vision application, the source of electrons is a photo-sensitive cathode rather than a field emission cathode as described herein. Light incident upon the photo-sensitive cathode causes the emission of electrons, usually from a surface that is specially coated with a material having a negative electron affinity. The low-intensity image that originates at the cathode is, thus, transferred to the viewing, screen after intensification resulting from amplification in the microchannel plate.

Microchannel plates in current use have typically been fabricated from arrays of microscopic glass cylinders with a channel density of between $10^5$ to $10^7$ per square centimeter. Galileo Electro-Optics Corporation is a manufacturer of glass microchannel plates. Details related to the Galileo microchannel plates are described by J. J. Fijol. et al in "Secondary Electron Yield of $SiO_2$ and $Si_3N_4$ Thin Films for Continuous Dynode Electron Multipliers." Applied Surface Science 48/49, pp. 464–471 (1991). Fabrication techniques for these microchaniel plates has been disclosed in U.S. Pat. Nos. 5,086,248 and 5,205,902, which are expressly incorporated by reference herein. Galileo has most recently developed a microchannel plate based upon silicon rather than glass. Details of the silicon plate's fabrication are reported under NIST ATP Contract Number 70NANB3H1371. Fabrication details for a silicon microchannel plate are also reported in "Characteristics and Applications of Advanced Technology Microchannel Plates" by J. R. Horton, et al. in SPIE, vol. 1306, Sensor Fusion III (1990). These documents are also expressly incorporated herein by reference.

Construction of a microchannel plate according to this invention typically entails the slicing, grinding and fine polish of a wafer of substrate material. The wafer is subsequently coated with a photoresist and exposed by photo lithography to generate a series of microscopic holes in the photoresist along a surface of the wafer. The holes are then exposed to a chemical etching process that etches away the substrate material within the confines of each hole to form a through-channel. A conductive layer is then formed over the surfaces of the wafer and in each channel. This conductive layer is applied, typically, by vapor deposition. Subsequently, an electron emissive layer is applied into the channels. As a final step, a metal surface is evaporated onto the opposing sides of the wafer to generate the dynode. Each wafer is typically inspected and tested prior to installation in a predetermined device.

Figure 4:
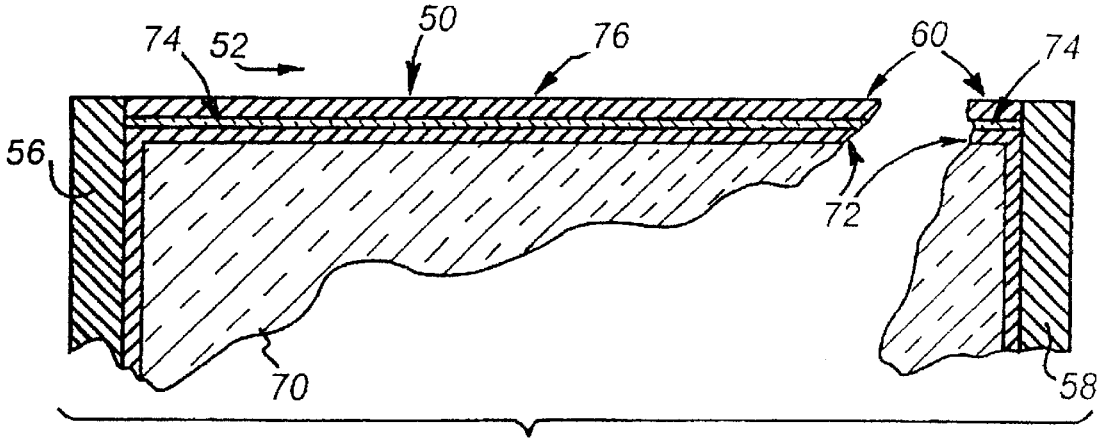
FIG. 4 is a more detailed partial schematic cross-section of the microchannel gain element of FIG. 3 illustrating the substitute layers thereof.

With reference to FIG. 4, it is contemplated that silicon can be used as a substrate 70 for a microchannel plate 50 according to this embodiment. Since silicon acts as a conductor even when it is nearly intrinsic, a high voltage across the length of the channel 52 would draw very high current and adversely affect operation of the microchannel plate 50. Accordingly, the underlying silicon substrate 79 is isolated from the applied voltage by an insulator that, in this embodiment, comprises an oxynitride film 72. Since $SiO_2$ and $Si_3N_4$ are both good secondary electron emitters, this film 72 could act as an electron emitter. However, if there is no continuous conducting path for the current path, the secondary emission current cannot be sustained and no amplification would occur. Thus, a thin conducting film 74, which can comprise amorphous silicon or another material, is deposited on the oxynitride 72 within the channel 52. This layer 74 provides a resistive bridge between the two dynodes while the oxynitride layer 72 insulates both the dynodes and the resistive "bridge" layer from the silicon substrate 70. Note that the lower insulating layer is typically unnecessary when the substrate comprises an insulator, such as glass.

A further layer of emissive oxynitride 76 is then deposited over the conductive layer 74. A high voltage is generated along the length of the resistive layer 74 due to its continuity with the deposited end conductors 56 and 58. The specific design of the conducting film 74 is generally specific to the microchannel plate application. For example, in an image intensifier, it is desirable that the anode current comprise only a small fraction of the current carried by the resistive film in the channel of the microchannel plate. In other words, the conductance of the film should be relatively high. High conductance avoids any non-linearity in the response of the microchannel plate and assures faithful reproduction of the object viewed to a resulting image. In a field emission device application, however, it can be desirable to avoid excess (parasitic) current in the resistive film to minimize power dissipation. As such, the resistive film 74 should typically exhibit lower conductance so that at least some saturation of the output current may occur.

Figure 5:
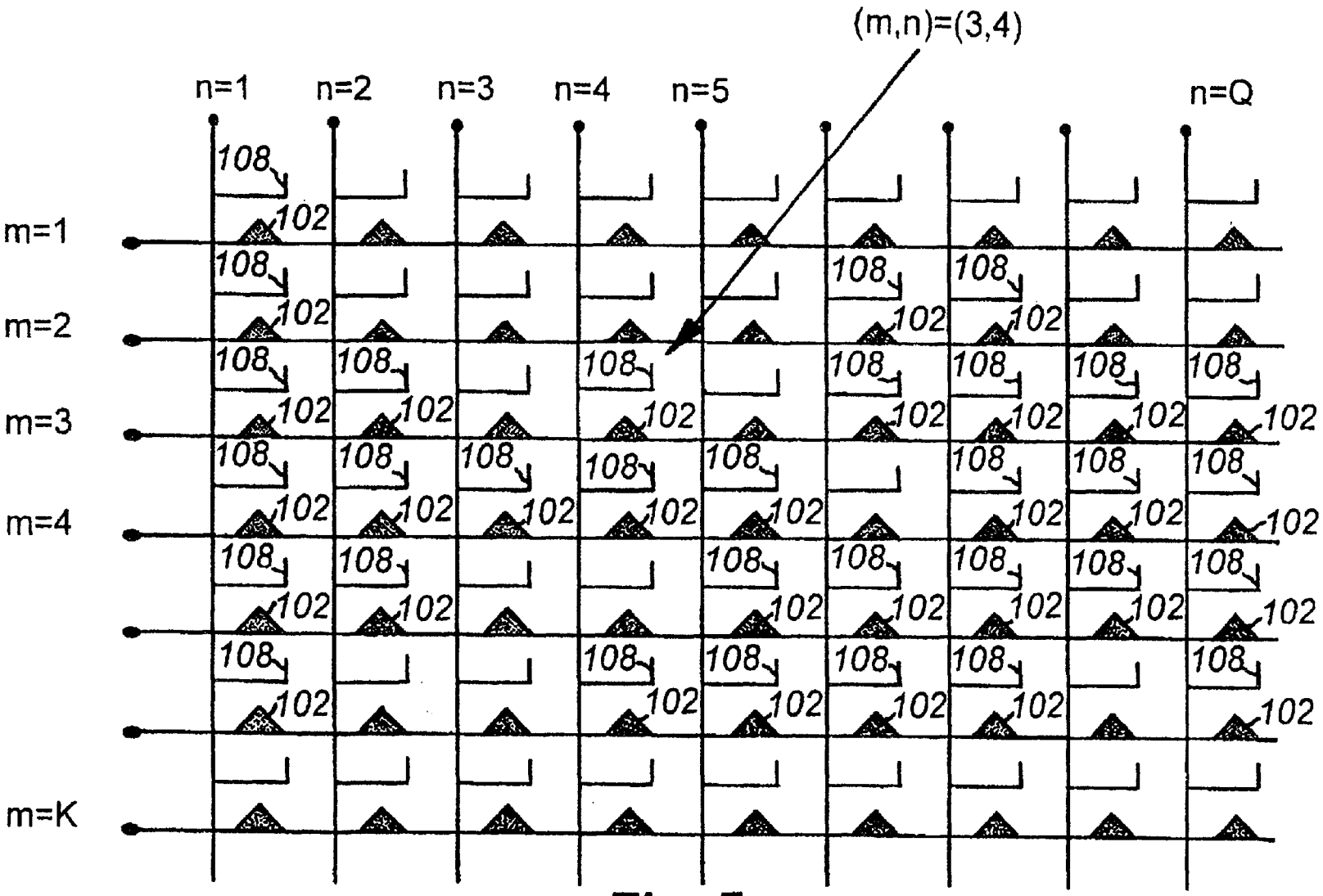
FIG. 5 is a schematic diagram of an array of field emission cathodes according to this invention.
Figure 6:
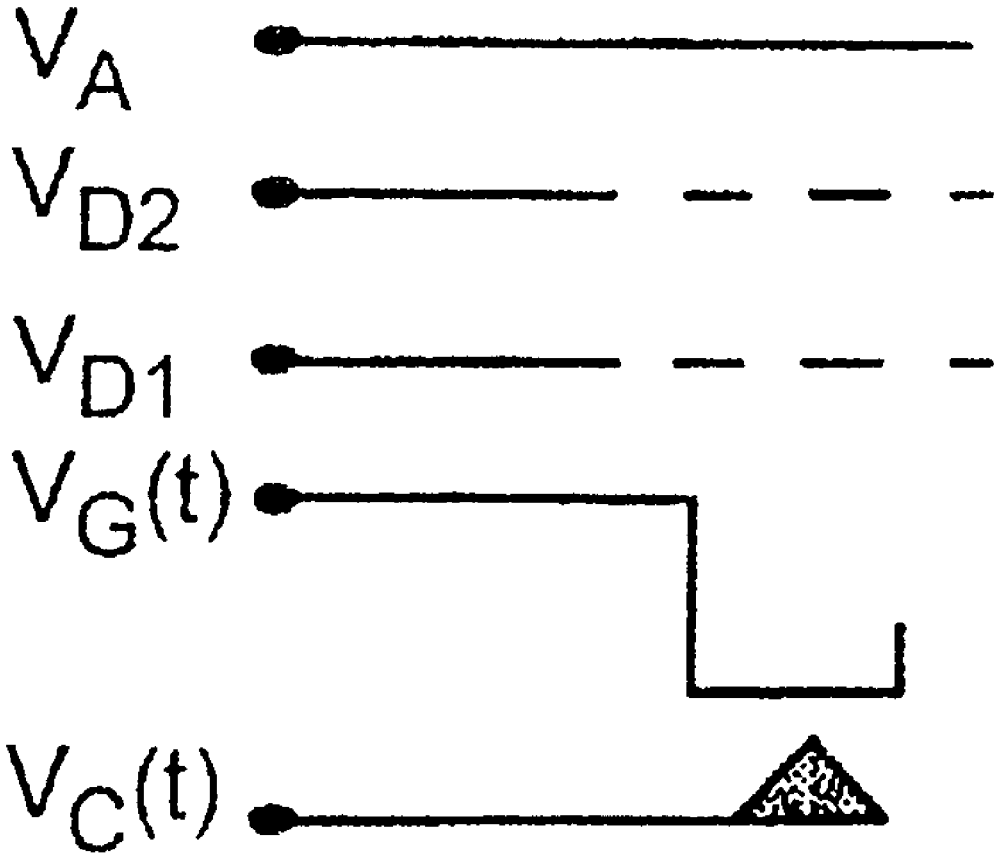
FIG. 6 is a voltage and timing diagram relative to the array of FIG. 5.
Figure 7:
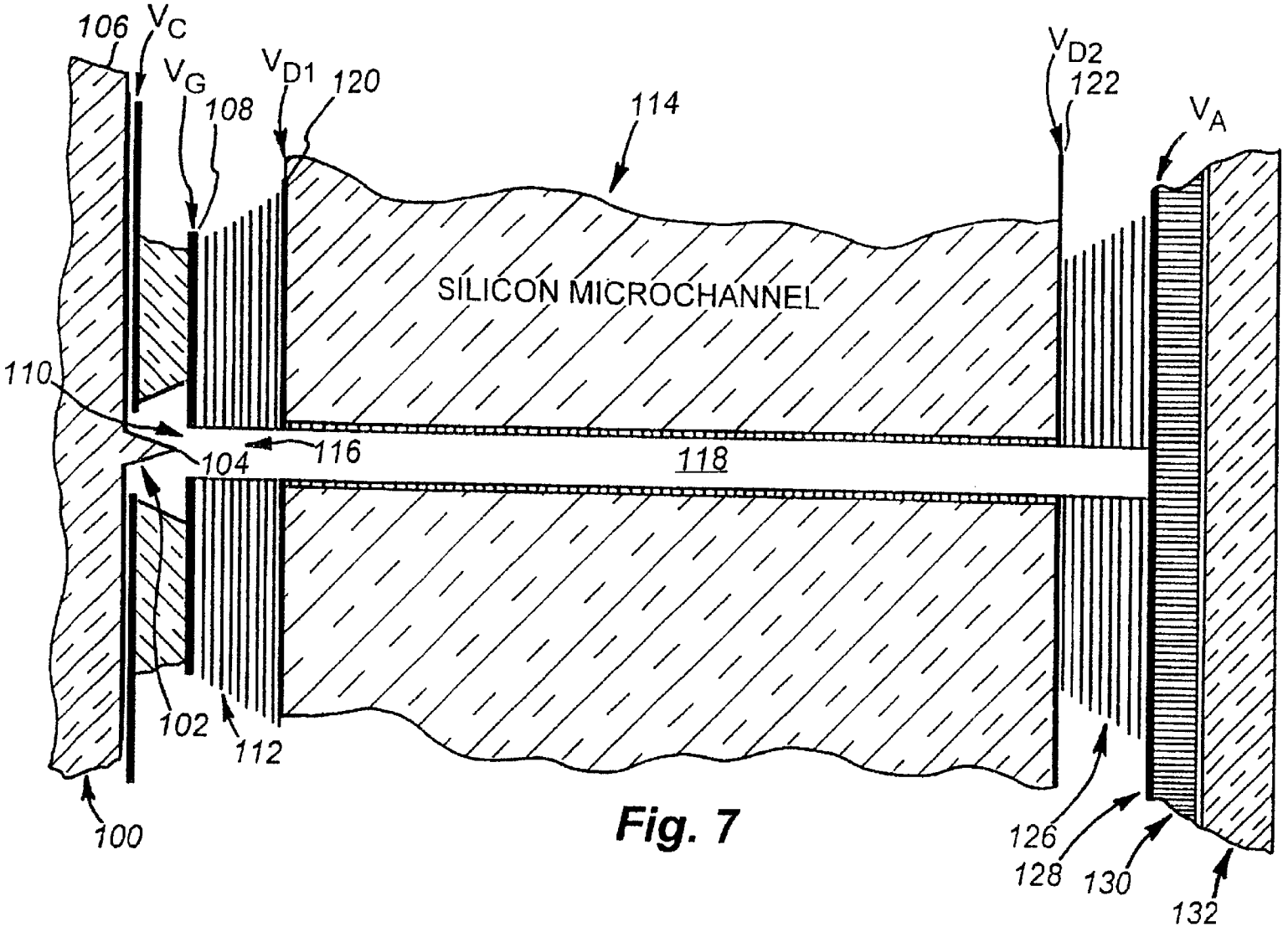
FIG. 7 is a schematic cross-section of a field emission device with a microchannel gain element installed in a flat panel display according to this invention.

FIGS. 5, 6 and 7 illustrate a specific implementation of the above-described field emission device with microchannel gain in a flat panel display. With reference to FIG. 7, the cross-section of a single emitter and channel is shown. It can be assumed that a practical flat panel display according to this invention would comprise a large array of such emitter and channels all located within an evacuated space. The details of such a display are described further below. The emitter structure detailed in FIG. 7 can comprise a single pixel of the display. Where color is utilized, it is desirable to have three individual subpixels that direct an electron beam onto three distinct phosphors that glow (for example) red, green and blue, respectively. It is contemplated that each subpixel can, in fact, consist of many emitters that each include a corresponding microchannel element. Thus, the term "pixel" as used herein is meant to include a plurality of constituent subpixels and/or emitter and microchannel structures. Furthermore, an emitter can be constructed from a plurality of cathode points all emitting electrons to a single microchannel. The term "emitter" or cathode should, therefore, be used broadly to define one or more individual tips in a cluster feeding a single aligned microchannel.

As described further below, with reference to addressing, each redundant emitter for a given subpixel is electrically connected in parallel. Similarly, for a monochromatic display, each monochromatic pixel can be formed from many emitters in parallel. It should be clear that one advantage of forming a single pixel from a plurality of emitters is that the failure of any one, or group, of emitters will not generally render the pixel inoperative.

FIG. 7 details a generic design for a single pixel or subpixel in a flat panel display according to this invention. The cathode 100 includes an emitter 102 that in this embodiment includes a pointed emitter tip 104. The emitter 102 is disposed on a substrate 106 that can comprise a plate having a plurality of cathode emitters 102 formed thereon. It is contemplated that each of the cathode emitters 102 is independently addressable by interconnections formed within the substrate 106 using, for example, lithographic circuit-forming techniques. As discussed above, a variety of known "cold" cathode structures can be used accordions to this invention. The difference between currently used field emission devices and the field emission device contemplated according to this invention is that the current derived from the cathode can be reduced by at least two orders of magnitude due to the amplification provided by the microchannel element. A grid 108 having a grid opening (gate) 110 is provided at the front of the cathode with the opening 110 aligned with the emitter 102. The grid facilitates modulation of the current from the cathode. Typical grid voltages can vary from 8 Volts to 140 Volts. The grid typically is biased at a constant voltage with a superimposed modulating voltage to achieve a desired emission of electrons from the cathode 102. The exact voltage used to drive the grid depends upon the performance of the cathode 106 and the gain obtained by the microchannel, as well as the sensitivity of the phosphor (so that an appropriate brightness is achieved for a given cathode current). A low grid voltage can enable the use of low-voltage CMOS drivers to drive the system and thus, can be preferable from a manufacturing and power consumption standpoint.

A spacer 112 is positioned between the grid 108 and the microchannel element 114 according to this invention. The thickness of the spacer 112 is a design option. The spacer 112 includes a channel 116 that enables electron flow from the cathode into the microchannel of the microchannel element 114. The spacer 12 can comprise any suitable insulating material. Another option is to eliminate the spacer and operate the grid and the first dynode at the same voltage.

The microchannel element 114 includes opposing conductive dynode plates 120 and 122. A constant voltage differential of between 600 and 1000 Volts is applied between the plates 120 and 122. The associated gain for the channel 118 will then be in the range of 100 to 200. A further spacer is provided adjacent plate 122. This spacer 126 is, again, a design option, but can be constructed of any appropriate insulating material. Adjacent to the spacer 126 is the anode structure 128. The anode 128 includes a phosphor element 130 that glows visibly in response to electron excitation. The phosphor element 130 is disposed upon a transparent plate 132 that can comprise glass according to this invention.

The construction of the phosphor element 130 and glass screen 132 can be identical to that of any conventional flat panel display. Industry is currently experimenting with numerous low-voltage phosphors for field emission device applications. The availability of low voltage phosphors that have efficient excitation and voltages of 100–200 Volts would enhance the performance of a flat-screen display according to this invention. However, it is contemplated that existing high-efficiency phosphors can be utilized according to this invention.

Since the gain of the channel 118 is in the range of 100 to 200, for a given anode current the cathode current will be approximately the same factor of 100 to 200 lower than without the presence of the microchannel element 114. Any excess current flowing through the microchannel element 114 that does not contribute to anode current is considered parasitic. However, designing a current saturation point into the microchannel output to enhance uniformity serves to lower the excess current and assures minimum dissipation. Excess saturation should be avoided if it is desired to display a gray scale or color where variable brightness (due to variable electron current) is required.

As discussed above, the flat panel display according to this invention comprises a large array of cathode emitters 102 with corresponding microchannels 118 each directed to a portion of a phosphor element 130 on a screen 132. Each pixel (which can be composed of a single emitter or a plurality of parallel-connected emitters) is individually addressable. For an exemplary ten inch diagonal full-color display having VGA resolution, the following parameters are contemplated:

Display area: (10 inch diagonal): 280 square centimeters;

Pixel pitch (at most) 300 microns between each pixel;

Pixel area: $9\times10^{-4}$ square centimeters:

Number of pixels: 300,000 (monochromatic);

Number of addressable subpixels: 900,000;

Number of cathodes for each subpixel: 3 (redundancy for enhanced reliability); and Total number of cathodes and microchannels: 2700,000.

For an average screen (anode) current of 1 milliamp, the average current-per-cathode, in the absence of microchannel plate would be 370 picoamps (1 milliamp/2,700.000). Using, a microchannel plate, biased to again of 100, the average,C current-per-cathode would be reduced to 3.7 picoamps (generally within an order of magnitude between 1–10 picoamps), with a corresponding reduction in driver voltage. The net power is approximately 1 watt (1 milliamp ×1000 Volts). In comparison, a backlighted active matrix liquid crystal digital display (AMLCD) consumes up to eight watts. Most of this power consumption is attributable to the fluorescent backlight.

With further reference to FIGS. 5 and 6, a basic addressing scheme for a display according to this invention is disclosed. To address any number of pixels in a dynamic manner, the timing of voltages applied to the cathode, gate, microchannel plate an anode must be controlled. Generally, the anode and microchannel plate can be held at constant voltages that are positive with respect to the gate and cathode. The gate and cathode are modulated to control cathode current. With reference again to FIG. 7, the voltages at each of the cathode 106, gate 108, conductive dynode surfaces of the microchannel plate 120 and 122 and anode 128 are $V_C$, $V_G$, $V_{D1}$, $VD_{D2}$ and $V_A$ respectively. The voltage scheme is generally $V_A>V_{D2}>V_{D1}>V_G>V_A$, with $V_A$, $V_{D1}$, and $VD_2$ held constant $V_G$ and $V_C$ variable in time for the purpose of addressing individual pixels. As noted above, individual color pixels consist of three subpixels, one each for red, green or blue according to this embodiment. Additionally, each subpixel may consist of many emitters, each with a corresponding microchannel element. These redundant emitters within a subpixel are, typically, electrically connected in parallel. In a monochromatic display, subpixels are not normally included, but each pixel can comprise many emitters in parallel as in a color display. Alternately, clustered emitters could be each separately addressable to control the brightness of a given pixel by, for example, activating a given number of clustered emitters at a given time to generate a corresponding brightness level based upon the number emitters.

As depicted, the array comprises a series of interconnected rows (m) and columns (n) of emitters 102 and gates 108 that are each individually addressable. As noted above, it can be assumed that a multiplicity of emitters can be connected in parallel for any given row (m) or column (n) subpixel. The total number K of rows and total number Q of columns vary depending upon the density of pixels and size of the display.

With reference to FIG. 6, at time t=0 the raster of rows (m) is initiated by applying a voltage to the cathodes common to the first rows (m=1) for a duration T1.

Any emitter 102 in the row can then be activated by applying a voltage during the same time interval to the intersecting gate column (n) corresponding to the emitter to be activated. The voltage difference $V_G-V_C$ at the emitter 102 must exceed the threshold voltage necessary to initiate the flow of current from the cathode. Note that there will also be a small but significant contribution to the net field at the cathode from voltages applied to the microchannel plate 114 and the anode 128. Thus, to activate an emitter 102 at any giving raster cycle, there must be present at that time an adequate field at the cathode derived from the applied voltages, especially those at the cathode and gate 108.

The timing for addressing an individual emitting element depends partly upon the properties of the phosphor 130. In particular, the persistence of the phosphor 130 will determine the raster rate at which the individual subpixels must be refreshed in order to avoid flicker in the display. Thus, T1 must be less than the duration of the raster cycle but sufficiently long that the intensity of a subpixel does not appear to decrease before it is refreshed on the subsequent raster scan. If the subpixel is not to be addressed on the subsequent raster scan, however, T1 in combination with the persistence of the phosplhor column must not be so long as to produce "ghost" images.

Figure 8:
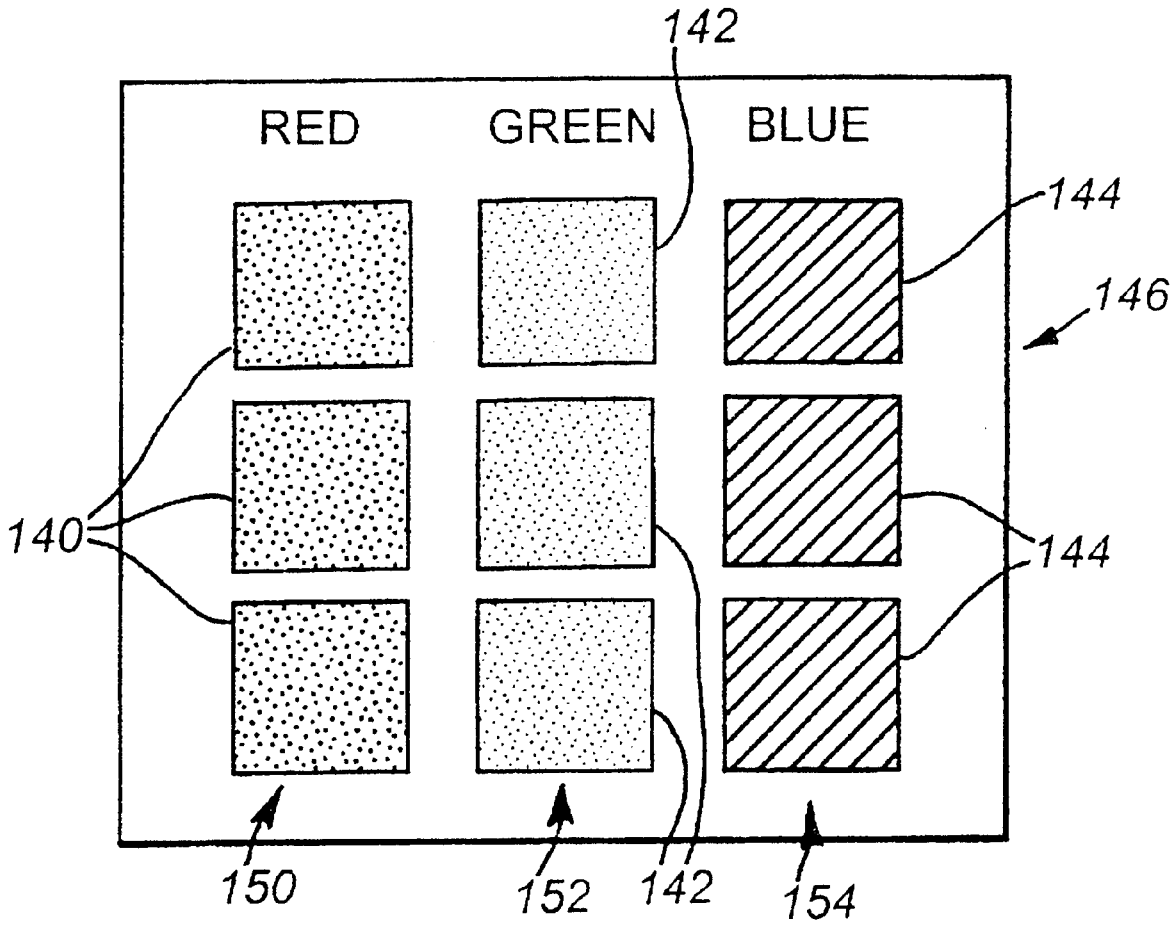
FIG. 8 is a schematic plan view of a grouping of primary color subpixels for use in a color display according to this invention.

With reference, finally, to FIG. 8, there is shown a schematic array of subpixels 140, 142 and 144 of a pixel 146 for use in a color display. The subpixels 140, 142, 144 are arranged in three side-by-side columns, corresponding to the primary colors red 150, green 152 and blue 154, respectively. Each subpixel column is composed of three parallel subpixels of like color. Each subpixel can receive electrons from one or more cathode emitters. It is contemplated that a larger or smaller number of subpixels can be utilized and that the subpixels can be organized in rows, columns or another clustering arrangement (such as triangles) relative to each other. The screen phosphor should be processed and aligned in a manner that corresponds with the desired pixel color. In this embodiment, each pixel (146) has a pitch relative to other pixels (not shown) of approximately 300 microns. The pitch between subpixels is approximately 90 microns.

Figure 9:
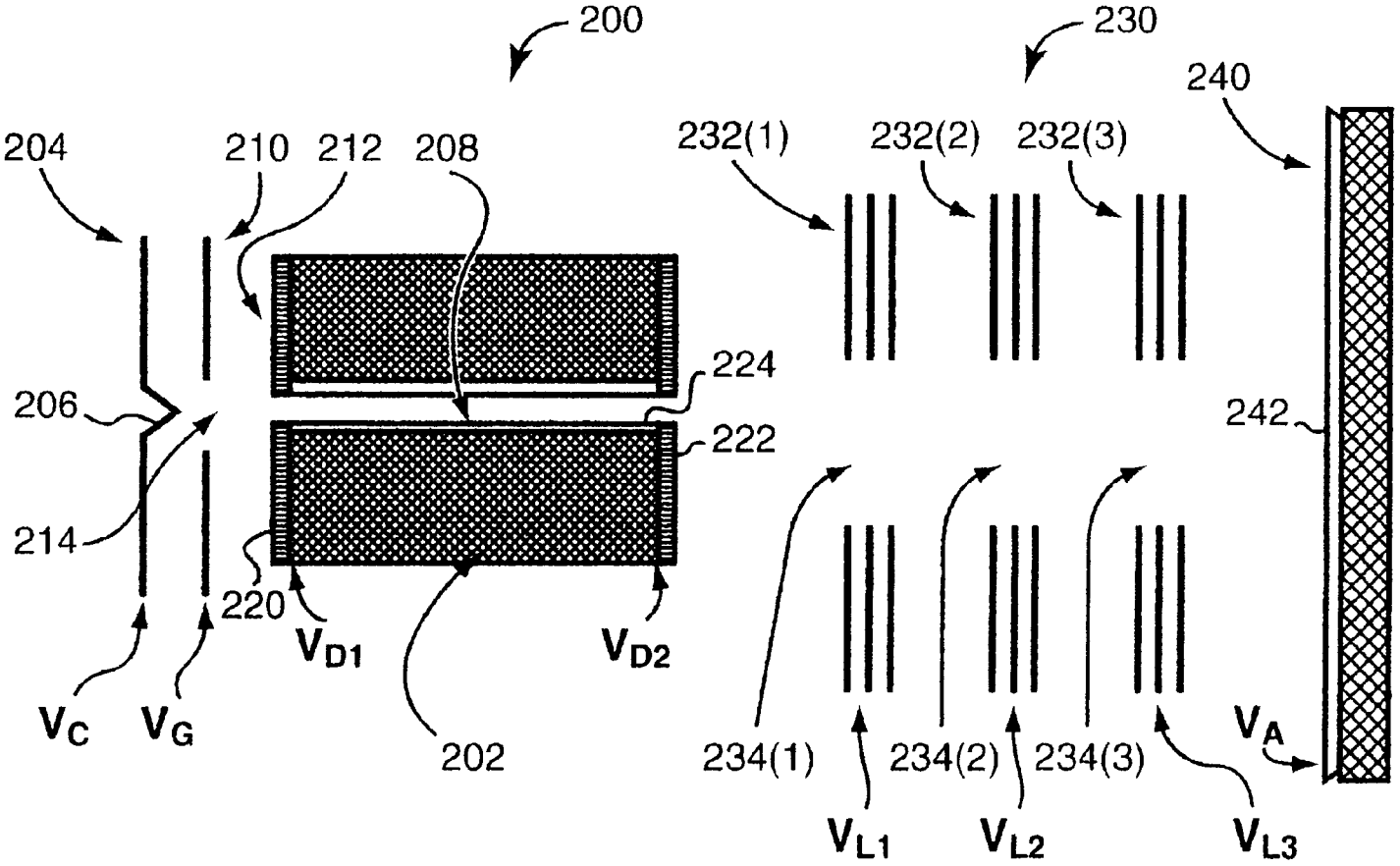
FIG. 9 is a schematic side view of a microchannel electron beam lithographic device according to an alternate embodiment of this invention.
Figure 10:
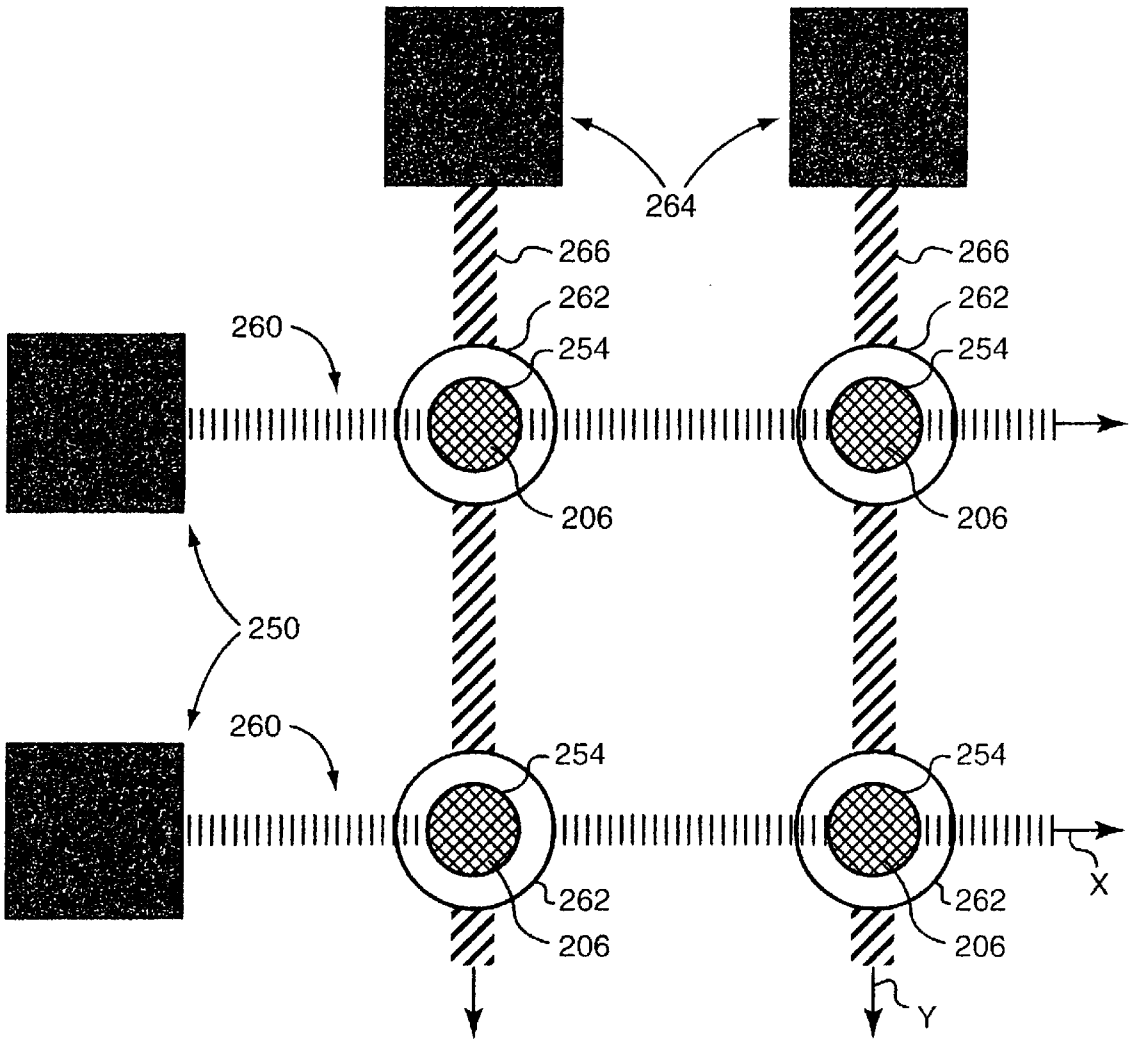
FIG. 10 is a partial schematic plan view detailing the two-dimensional arrangement of the lithographic device of FIG. 9.
Figure 11:
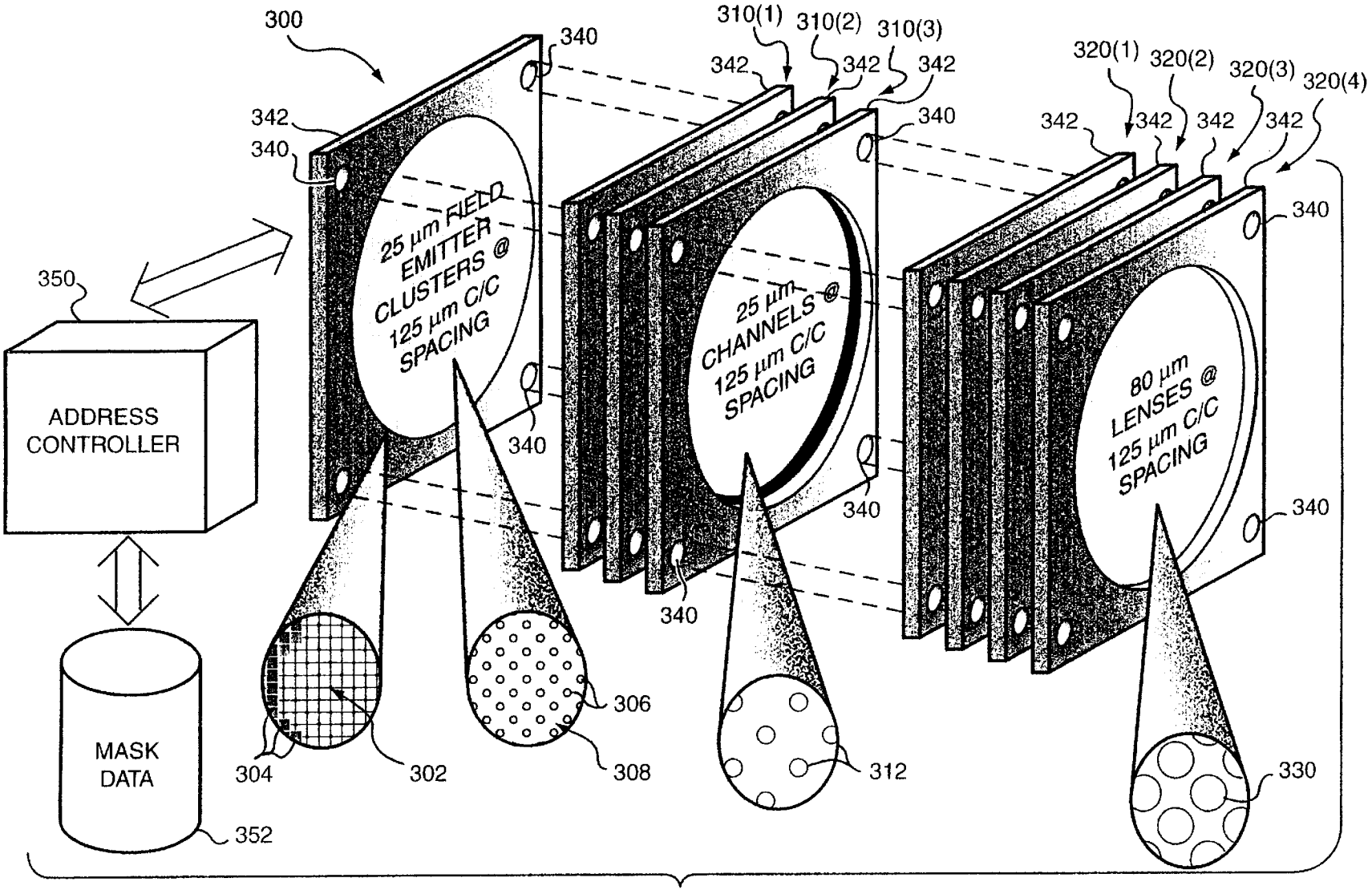
FIG. 11 is an exploded perspective view of an electron beam lithographic device according to this invention for use in the manufacture of semiconductor circuits.

FIGS. 9–11 detail an embodiment of this invention for use in electron beam lithographic processes used, for example, in the manufacture of semiconductor microcircuit chips. FIG. 9 details, in side view, a generalized arrangement for an electron beam lithography device 200 with a microchannel plate 202 to provide gain to a cold cathode structure 204 according to an embodiment of this invention. The cold cathode structure 204, in particular, comprises an emitter 206 (shown as a generalized point) having one or more individual cathode tips, adjacent to a respective plate channel 208. The emitter 206, as noted above, can be a single tip with respect to a given channel, or can comprise several tips in a cluster, aligned with the respective channel 208. In a preferred embodiment, 30–40 tips can comprise a single "emitter" aligned with respect to a given channel 208. As will be described further, there is provided a large number of cathodes and respective channels arranged in a two-dimensional array to contemporaneously produce a large number of individual, amplified electron beams over a given area. All are generally powered by a similar voltage $V_C$. The cathodes can be individually powered as an option.

A gate or "grid" 210 is provided between the cathode structure 204 and the input side 212 of the microchannel plate 202. Grid openings 214, that are independently addressed, modulate emissions of electrons from each emitter 206 into a respective channel 208. The structure and function of the grid 210 and the microchannel plate 202 are in accordance with the principles already described above. Briefly a pair of dynode plates or sides 220 and 222 are located at the respective input face and output face of the microchannel plate 202. The sides are driven at respective voltages $V_{D1}$, and $V_{D2}$ to define a corresponding voltage differential across the microchannel plate 202. An electron-emissive layer 224, as also described above is provided to the inner surface each channel, which is typically cylindrical, substantially along the entire length of the channel, the channel causes a massive gain by producing a cascade of secondary electrons for each of electron striking the channel—the striking electrons being from either the cathode emitter 206 itself, or from a downstream rebound by secondary electrons (see FIG. 3).

Electrons exiting each channel 208 pass thorough an electrostatic lens structure 230 that comprises a series of three parallel lens plates 232(1), 232(2) and 232(3) in this embodiment. Each of the lens plates has, in turn, three stacked elements each. The number of lens plates and elements within the plates can be varied, and the number shown should be taken only by way of example. The lens plates each have respective apertures 234(1), 234(2) and 234(3) aligned with the outlet of a respective channel 208. Each lens 232(1), 232(2) and 232(3) is driven at a respective driving voltage $V_{L1}$, $V_{L2}$ and $V_{L3}$.

The overall lens "stack" shown in FIG. 9 is a schelatic representation of a typical electrostatic focusing system. In almost all cases the lens stack is comprised of metal lens elements each having apertures through which the beam passes. As the electron beam emerges from the channel 208 it is drawn by a more-positive voltage into aperture 234(1) of the first lens 232(1). In this embodiment, each microchannel is aligned with a corresponding set of lens stack apertures. The complexity and number of elements in the lens stack are determined by any existing aberrations that have to be corrected in order to focus the beam to a minimum spot size. The voltages through the stack rise and fall accordingly. Typical aberrations that have to be corrected are related to the size of the source that is to be imaged, the energy spread of the emerging electrons and their angular distribution. In this example, the source to be imaged is tile output end of the microchannel.

The magnitude of the voltages on the various lens elements also depends upon the sensitivity of the electron beam resist at the anode as well as the above cited aberrations. For a thin, low voltage resist the final voltage $V_{L3}$ in the stack may be as low as 1000 V. Inside the stack, voltages may rise and fall throughout the range of 100 V to 4000 V. In an embodiment that has been designed and simulated, the lens stack has ten elements with the following progression of voltages away from the microchannel for one particular configuration: 100 V, 88 V, 500 V, 500 V, 553 V, 2000 V, 2000 V, 2000 V, 3684 V, 1000 V, with the anode resist at $V_A$=1000 V, In addition to the voltages, the spacing of the lens elements should be closely controlled. For the above-described embodiment, the overall height of the stack, that is, the distance from the microchannel to the resist target at the anode, is approximately 25 mm.

The lenses focus each amplified electron beam into a point, which can be circular in cross-section, having a diameter of less than 100 nm. The point beam, in this embodiment is used to strike a portion of a semiconductor substrate 240, having a resist layer 242 that is altered by the beam, Hence, in this embodiment, the substrate 240 comprises the anode that absorbs the beams electrons. It is maintained at a voltage potential $V_A$, that has a value typically in accordance with the factors described above. The resist layer 242 can be any acceptable thin film coating composed of polymers or other compounds that reacts selectively to a concentrated electron beam without substantial spreading of the exposure effect beyond the directly affected area. The layer 242 can either be a substance that undergoes a chemical change that allows selective etching in a subsequent step, or a substance that is actually removed by the electron beam in selected areas to reveal the semiconductor surface below for further processing.

FIG. 10 details a small portion of an electron beam lithography array, implementing the elements described in FIG. 9, is shown in plan view looking downwardly from the output of the lenses. In particular, a corner of an array of multiple rows and multiple columns of beam generators (as the component layers/plates will be collectively termed) is shown. Rows extend in the direction of arrow Y, while columns extend in the direction of arrow X. The number of rows and columns can vary depending upon the size of the overall array and the number of separate beams (and the density of beams) being employed. The spacing between beam generators is also variable and depends partly upon how closely the generators can be placed from one another in fabrication. In this embodiment row address pads 250, connected with an address controller (not shown) provide driving voltage to the cathode clusters 206 through cathode address lines 260 formed on the cathode plate. Likewise, column address pads 264 interconnect a grid address controller (not shown) with the appropriate grid section for each cathode cluster. Note, the perimeter of the grid aperture is represented by the circles 254. Grid address lines 266 are provided on the grid plate. The microchannel plate channels are not visible, but are sandwiched between the grid lines and the lens structure apertures represented by the circles 262.

With further reference to FIG. 11, the complete electron beam lithography device is detailed in exploded view. Each element of the device comprises a separate plate that can be formed using appropriate semiconductor fabrication techniques that are currently available. In practice, the entire lithography device is typically enclosed in an evacuated chamber so that electrons can pass through the device and strike the anode substantially free of the effects of gas molecules. In one embodiment, the cathode, or field emitter, array 300 is the first plate in the stack. In close-up are shown the filed emitter clusters with associated grid (302). Address pads for connecting to the controller are shown. The address pads enable selective operation of particular emitters. Each cluster is spaced by 125 microns on-center in this embodiment. However, it is expressly contemplated that the spacing can vary significantly in alternate implementations.

The cathode/emitter clusters 306 themselves are shown in close-up 308. Each cathode is spaced on-center at 5 microns, and thirty to forty are grouped together in this embodiment.

Three stacked microchannel plates 310(1), 310(2) and 310(3) are used in this embodiment. It is expressly contemplated that any number of microchannel plates, with microchannels allied can be stacked together to further multiply the gain effect. Each microchannel plate is powered as described above. The driving voltages may vary from plate-to-plate depending upon the application. Precise voltages can be determined experimentally by operating the unit to obtain the proper gain to produce a beam of electrons having, a desired current. A close-up of a microchannel plate surface reveals the individual microchannels 312, each having an inside diameter of 25 microns and an on-center spacing of 125 microns, in alignment with associated emitter clusters.

Downstream of the microchannel plates are positioned the electrostatic lenses 320(1), 320(2), 320(3) and 320(4). Each individual lens element is driven at a substantially constant driving voltage across its surface, and as described above, the voltages vary from lens to lens to create the desired focusing (effect at the outlet. In this embodiment a focused spot size of 100 nm or less. The apertures 330 in each lens, as shown in close-up are 80 microns in diameter. Likewise the apertures 330 are spaced on-center at 125 microns and are aligned with the emitters and the microchannels.

The alignment of the elements of the device can be accomplished using conventional alignment techniques for semiconductor devices. Connecting lugs 340 are provided in the element frame pieces 344. Any acceptable housing or connector arrangement can be employed to join the elements together. Likewise a variety of connectors and wires (not shown) can interconnect each of the elements with appropriate electronic controllers and voltage sources in a manner clear to one of ordinary skill. In particular, an address controller 350, comprising any acceptable data processing device such as a high-performance minicomputer or microcomputer used in semiconductor fabrication techniques, is interfaced with the row and column address pads on the emitter/grid plates. The controller 350 receives a design pattern, representing a desired circuit pathway, from a data storage device, such as the computer disc drive 352.

It is contemplated that the beams can be provided over an area as large as the area of a typical semiconductor wafer. Accordingly, an entire semiconductor wafer can be exposed in motions limited to the spacing between electron beams. Alternatively beams can be provided over a significant area of a wafer and stepper movement, or another technique can be employed to move the beams about the wafer.

In operation, a design pattern for an integrated circuit is provided in data form to a controller. The controller addresses the appropriate emitter/grid structures within the device to simultaneously expose the wafer in the design pattern. The beams are operated as the resist-coated wafer is moved relative to the electron beams. The motion of the wafer relative to the electron beams is accomplished through a precision X–Y translation stage of the overall lithography device. By synchronizing the motion of the stage with the activation and deactivation of the emitter array, according to the controller's preprogrammed addressing scheme, the pattern of the integrated circuit is replicated in the electron beam resist. Because of the highly parallel nature of the address scheme, the production of high-density circuits is substantially accelerated in comparison to the prior art. Again, this is because the prior art depends upon serially addressing the pattern, which is slow in comparison.

The foregoing has been a detailed description of a preferred embodiment of this invention. Various modifications and additions are contemplated without departing from the spirit and scope of this invention. For example, the principles described herein in FIGS. 5, 6 and 7, while related to a flat panel display, can be applied with modifications to other imaging devices such as an electron microscope or a electron beam lithography device and vice versa. In particular any output from the microchannel plate herein can be focused using one or more electrostatic or equivalent lenses before it strikes an appropriate anode. The parameters of the microchannel, gate structure and cathode structure could be altered to meet the specific needs of an electron microscopic or lithographic environment as generally described herein. Accordingly, this description is meant to be taken only by way of example and to otherwise limit the scope of the invention.

What is claimed is:

1. A field emission device comprising:

a plurality of field emission cathodes for generating a plurality of streams of electrons;

a gate structure positioned relative to each of the field emission cathodes for modulating the stream of electrons generated by each of the field emission cathodes;

a microchannel gain element having:

(i) a first dynode side adjacent the gate and an opposing, second dynode side, wherein each of the first and second dynode sides includes a conductive material thereon having a voltage difference therebetween, and (ii) a plurality of microchannels each having a secondary electron-emissive layer therein and each located adjacent each of the plurality of field emission cathodes for providing a gain to each of the streams of electrons; and an anode positioned adjacent the second dynode side, the anode absorbing electrons from each of the plurality of streams of electrons.

2. The field emission device as set forth in claim 1, wherein the anode comprises a transparent screen having phosphor thereon.

3. The field emission device as set forth in claim 1, wherein the microchannel gain element comprises a plate having a substrate constructed from glass.

4. The field emission device as set forth in claim 1, wherein the microchannel gain element comprises a substrate constructed from silicon.

5. The field emission device as set forth in claim 4, wherein the microchannel gain element includes an insulating latter located thereon and alone a surface of each of the microchannel and wherein each of the first dynode side and the second dynode side are insulated from the substrate by the insulating layer and further comprising a resistive bridge layer interconnecting each of the first dynode side and the second dynode side and the resistive bridge layer being insulated from the substrate by the insulating layer.

6. The field emission device as set forth in claim 1, wherein the microchannel gain element comprises a substrate constructed from a metal.

7. The field emission device as set forth in claim 1 further comprising an electrostatic lens structure located between the microchannel rain element and the anode for focusing each of the plurality of streams of electrons.

8. The field emission device as set forth in claim 1, wherein the anode comprises a semiconductor substrate having a resist layer that is selectively acted upon in a localized region thereof by the plurality of streams.

9. The field emission device as set forth in claim 8, further comprising an address controller interconnected with at least one of the field emission cathodes and the gate structure that controls emission of electrons from the cathodes selectively according to a predetermined circuit design pattern whereby a corresponding pattern is produced the resist layer.

10. The field emission device as set forth in claim 1, wherein the plurality of field emission cathodes comprise groupings that correspond to a plurality of pixels and wherein the anode comprises a display for displaying the pixels.

11. The field emission device as set forth in claim 10, wherein the display is constructed and arranged to display at least 300,000 pixels.

12. The field emission device as set forth in claim 1, wherein each of the first dynode side and the second dynode side of the microchannel lain element are driven at a predetermined voltage and wherein a difference between the predetermined voltage oil each of the first dynode side and the second dynode side is in a range between approximately 600 and 1000 Volts.

13. The field emission device as set forth in claim 1, comprising at least 2,000,000 field emission cathodes.

14. The field emission device as set forth in claim 1 wherein each of the cathodes generates a current of the order of 1 picoamp.

15. The field emission device as set forth in claim 1 wherein each of the cathodes comprises a cluster of a plurality of cathode tips all aligned with a predetermined microchannel of the plurality of microchannels.

16. The field emission device as set forth in claim 1, wherein the plurality of field emission cathodes comprise groupings that correspond to electron beams used in a lithographic process and wherein the anode comprises a resist layer that is selectively exposed by the electron beams.

17. A method for inducing a current gain in a stream of electrons emitted by a field emission device comprising the steps of:

emitting a stream of electrons having a first current from a field emission device;

directing the stream of electrons having the first current into a microchannel of a microchannel gain element, the microchannel gain element having:

(i) a first dynode side and an opposing, second dynode side, wherein each of the first and second dynode sides includes a conductive material thereon having a voltage difference therebetween, and (ii) a plurality of microchannels each having a secondary electronemissive layer therein and each located adjacent a field emission device;

applying a driving voltage to the microchannel in which the stream of electrons having the first current is directed to generate a resulting stream of electrons that exits the microchannel having a second current that is greater than the first current; and striking an anode with the resulting stream of electrons having the second current.

18. The method as set forth in claim 17, wherein the step of striking includes exciting with the resulting stream of electrons, a visible light emission from a phosphor located on the anode.

19. The method as set forth in claim 18, wherein the step of exciting includes exciting a phosphor that emits a substantially greater visible light in response to contact by the resulting stream of electrons having the second Current than a visible light emission by the phosphor in response to contact by a stream of electrons having the first current.

20. The method as set forth in claim 17, wherein the step of striking includes exposing a resist layer on a lithographic substrate.

21. The method as set forth in claim 20, wherein the step of exposing includes focusing the stream with an electrostatic lens structure positioned between the microchannel gain element and the substrate.

22. The method as set forth in claim 21, further comprising, directing a plurality of streams of electrons through discrete microchannels of the microchannel gain element, the step of directing further including selectively addressing a plurality of field emission devices to according to a selected two-dimensional pattern to produce a predetermined exposure pattern on the substrate.

23. The method as set forth in claim 22, further comprising moving the substrate relative to the streams of electrons between exposure passes to expose adjacent locations on the substrate between previously exposed portions whereby a complete exposure pattern is created on the substrate.

24. A field emission device adapted for use in a lithographic process, the field emission device comprising:

a plurality of field emission cathodes for generating a plurality of streams of electrons;

a gate structure positioned relative to each of the field emission cathodes for modulating the stream of electrons generated by each of the field emission cathodes;

a microchannel gain element having:

(i) a first dynode side adjacent the gate and an opposing, second dynode side, wherein each of the first and second dynode sides includes a conductive material thereon having a voltage difference therebetween, and (ii) a plurality of microchannels each having a secondary electron-emissive layer therein and each located adjacent each of the plurality of field emission cathodes for providing a gain to each of the streams of electrons; and an anode positioned adjacent the second dynode side, the anode adapted to facilitate exposure of a resist layer by the plurality of streams of electrons.

25. The field emission device as set forth in claim 24, further comprising an electrostatic lens structure located between the microchannel gain element and the anode for focusing each of the plurality of streams of electrons.

26. The field emission device as set forth in claim 24, wherein at least one of the field emission cathodes and the gate structure are adapted to be interconnected with an address controller that controls emission of electrons from the cathodes selectively according to a predetermined circuit design pattern whereby a corresponding pattern is produced in the resist layer.

* * * * *

UNITED STATES PATENT AND TRADEMARK OFFICE

CERTIFICATE OF CORRECTION

PATENT NO. : 6,522,061 B1
DATED : February 18, 2003
INVENTOR(S) : Harry F. Lockwood It is certified that error appears in the above-identified patent and that said Letters Patent is hereby corrected as shown below:

Title page,
Item [74], the *Attorney, Agent, or Firm* segment has been omitted. Please insert the following under the *Primary Examiner* segment:

-- *Attorney, Agent, or Firm* - Cesari and McKenna, LLP; William A. Loginov --

Signed and Sealed this

Twenty-fourth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,522,061 B1
DATED : February 18, 2003
INVENTOR(S) : Harry F. Lockwood It is certified that error appears in the above-identified patent and that said Letters Patent is hereby corrected as shown below:

Column 15,
Line 64, delete “latter” substitute -- layer --
Line 64, delete “alone” substitute -- along --
Line 65, delete “microchannel” substitute -- microchannels --

Column 16,
Line 9, delete “rain” substitute -- gain --
Line 20, delete “produced the resist layer” substitute -- produced in the resist layer --
Line 31, delete “lain” substitute -- gain --
Line 33, delete “oil” substitute -- on --
Line 63, delete “electronemissive” substitute -- electron-emissive --

Column 17,
Line 12, delete “Current” substitute -- current --
Line 26, delete “devices to according” substitute -- devices according --

Signed and Sealed this

Twenty-seventh Day of January, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,522,061 B1
DATED : February 18, 2003
INVENTOR(S) : Harry F. Lockwood It is certified that error appears in the above-identified patent and that said Letters Patent is hereby corrected as shown below:

Title page,
Item [60], Related U.S. Application Data, please delete the current data and replace it with the following:
-- Continuation-in-part of application No. 08/416,079, filed on April 4, 1995, now Pat. No. 5,729,244. --

Column 1,
Line 3, "Related Appliation", please delete the current text and replace it with the following:
-- This is a U.S. national application of PCT/US98/05127, filed March 16, 1998, which is a continuation-in-part of copending U.S. patent applciation Ser. No. 08/416,079, filed April 4, 1995, now U.S. Patent No. 5,729,244, which issued March 17, 1998. --

Signed and Sealed this

Nineteenth Day of October, 2004

JON W. DUDAS
*Director of the United States Patent and Trademark Office*